US006645041B2

(12) United States Patent
Sørensen

(10) Patent No.: US 6,645,041 B2
(45) Date of Patent: Nov. 11, 2003

(54) BRASSIERE, MAINLY FOR USE WHEN NURSING

(75) Inventor: Bettina Balslev Sørensen, Silkeborg (DK)

(73) Assignee: Tytex A/S, Ikast (DK)

( * ) Notice: Subject to any disclaimer, the term of this patent is extended or adjusted under 35 U.S.C. 154(b) by 0 days.

(21) Appl. No.: 10/131,483

(22) Filed: Apr. 25, 2002

(65) Prior Publication Data

US 2003/0186617 A1 Oct. 2, 2003

(30) Foreign Application Priority Data

Apr. 2, 2002 (DK) ..... 2002 00483

(51) Int. Cl.[7] ..... A41C 3/00
(52) U.S. Cl. ..... 450/36; 450/8; 2/104
(58) Field of Search ..... 450/36, 37, 7, 450/8, 10, 11, 12, 14–16, 18, 65, 66, 70, 79, 92, 93, 1; 2/104, 69; 66/169 R, 170, 171, 190

(56) References Cited

U.S. PATENT DOCUMENTS 3,772,899 A * 11/1973 Novi ..... 66/176
4,390,024 A * 6/1983 Williams ..... 450/37
5,479,791 A * 1/1996 Osborne ..... 66/171
5,553,468 A * 9/1996 Osborne ..... 66/171
5,592,836 A * 1/1997 Schuster et al. ..... 66/176
5,873,767 A * 2/1999 Pickett ..... 450/1
5,946,944 A * 9/1999 Osborne ..... 66/176
6,083,079 A * 7/2000 Pearson ..... 450/1
6,125,664 A * 10/2000 Browder, Jr. ..... 66/176
6,178,784 B1 * 1/2001 Marley, Jr. ..... 66/176
6,287,168 B1 * 9/2001 Rabinowicz ..... 450/75
6,361,398 B1 * 3/2002 Knapp ..... 450/37

* cited by examiner

*Primary Examiner*—Gloria M. Hale
(74) *Attorney, Agent, or Firm*—James Creighton Wray; Meera P. Narasimhan

(57) ABSTRACT

The present invention relates to a brassiere which is especially suited for women nursing their child and where the brassiere is provided in a double layer and without seams and which allows the women easy access to expose one breast at a time by unfastening a clasp device and, subsequently, pull down the outer layer of the brassiere.

11 Claims, 7 Drawing Sheets

BRASSIERE, MAINLY FOR USE WHEN NURSING

Figure 1:
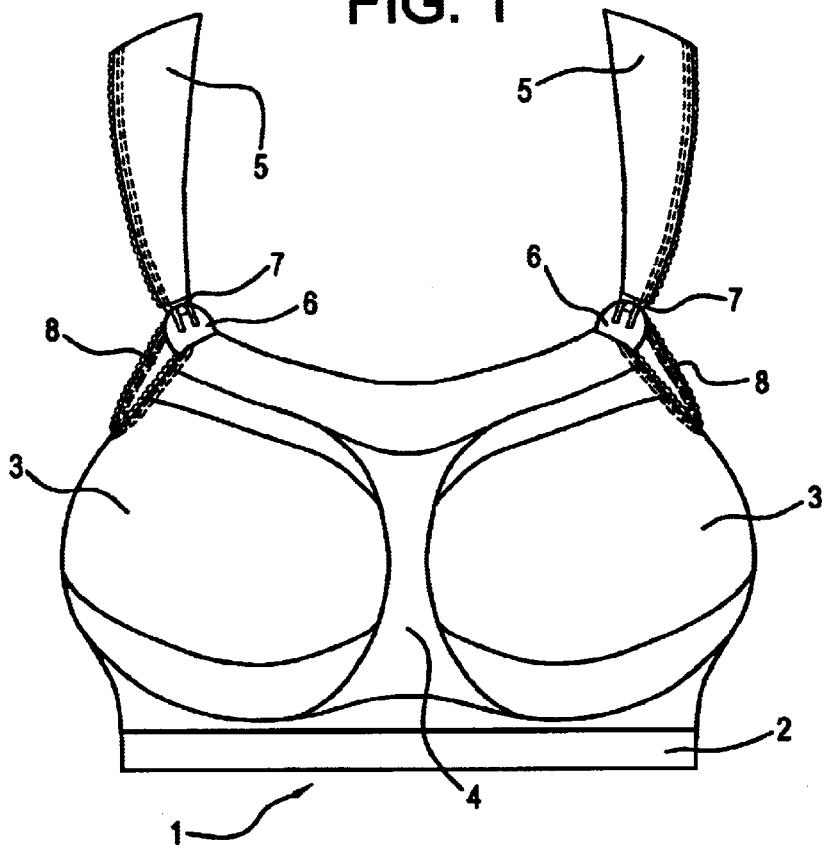

This application claims the benefit of Danish Application No. PA 2002 00483 filed Apr. 2, 2002.

FIELD OF THE INVENTION

The present invention relates to a brassiere, preferably for use when nursing, comprising a front portion with two cups, wherein a center portion is arranged between the two cups, a back portion, two side portions connecting the front and back portion, a band fitting snugly around the chest under the breasts and a pair of shoulder straps extending from the back portion and connected to each of the cups of the front portion and wherein the cups are completely or partly formed from a double layered fabric.

BACKGROUND OF THE INVENTION

For a woman nursing a child the use of a traditional brassiere can cause problems, since this often is designed so that the woman in order to expose a breast has to do one of the following:

- lift the cup up over the breast thus placing the cup on top of the breast, which causes the cup and band to press/pull down on the breast tissue and which may cause a stop in the lactation;
- open the brassiere so that the brassiere is so loose that it is possible to expose a breast. However, this causes a lack of support from the brassiere for the breast not used for nursing and it can be difficult to hold a child and at the same time try to open/close the brassiere with one hand.
- pull the shoulder strap down the shoulder, which means that the woman must pull off her clothes partly. In some situations having to undress in order to nurse a child is not desirable for a woman.

Furthermore, there are a number of traditional brassieres designed mainly for nursing women. Nursing brassieres have previously been made from several different pieces of fabric which have been subsequently sewn together causing a lot of seams. Those seams can irritate nursing women as their breasts are already tense and very sore. These women will thus feel some discomfort when using a brassiere with a number of seams which may irritate or apply pressure on the breast tissue.

U.S. Pat. No. 6,287,168 discloses how a substantially seamless brassiere is made from a circularly knitted fabric blank and the way in which the brassiere can be made from either a single layer or a double layered fabric. The type of brassiere described is unsuitable for use when nursing since it cannot open in the front. It is only possible to adjust the length of the shoulder strap, which will not help a nursing woman because she still has to either pull a cup up over or under the breast, pull the shoulder strap down the shoulder or loosen the brassiere in order to expose a breast.

OBJECT OF THE INVENTION

It is, therefore, the object of the present invention to provide a substantially seamless brassiere which is comfortable to wear, allowing the woman easy access to expose one breast at a time.

SUMMARY OF THE INVENTION

This is achieved with a brassiere characterized in that the brassiere is manufactured substantially without seams from a piece of circularly knitted fabric, wherein, at a position immediately above or at the upper edge of each cup, a first clasp is provided, which co-operates in a easily releasable manner with a corresponding second clasp on a shoulder strap and wherein said second clasp connects the shoulder strap with an inner cup layer.

In this connection a seamless brassiere is understood as a brassiere in which there are no seams in the cups, the front and back portion, but in which there may be seams in marginal areas such as the outer edge and arm openings.

In the following a brassiere is described for use by nursing women, but the invention also applies in other situations, such as:

- during the nursing period where a nursing pad can be fastened between the inner and outer cups of the brassiere,
- during pregnancy where an especially elastic brassiere will be useable since the size of the women's breasts is increased and they are at times sore and tense,
- after breast surgery where a brassiere with a double layered cup can be used for holding a breast prosthesis,
- for bandaging where a brassiere with a double layered cup can be used as various bandages can be placed between the two layers.

In order to manufacture a brassiere which is comfortable for women to wear and allows a nursing woman easy access to exposing one breast at a time, the brassiere according to the invention has been provided such that the brassiere, preferably for use when nursing, comprises a front portion with two cups, wherein a center portion is arranged between the two cups, a back portion, two side portions connecting the front and back portion, a band which fits snugly around the chest under the breasts and a pair of shoulder straps extending from the back portion and connected to each of the cups of the front portion and where the cups are completely or partly formed from a double layered fabric, where the brassiere is manufactured without seams from a piece of circularly knitted fabric, wherein at a position immediately above or at the upper edge of each cup a first clasp is provided, which co-operates in a easily releasable manner with a corresponding second clasp on a shoulder strap and wherein said second clasp connects the shoulder strap with an inner cup layer.

This embodiment of a brassiere makes it possible for a woman nursing her child to use a brassiere which, because of the seamless design, is comfortable to wear since there are no or very few seams to irritate the tense and sore breasts.

Because of the design of the two clasps, the shoulder strap is connected to both the inner cup and the outer cup of the brassiere when the woman is not nursing. The clasps make it easy for a woman to loosen the outer cup of the brassiere and pull the outer cup down in order to expose one or both breasts without experiencing the problems that can arise when a woman either has to loosen the brassiere or pull the shoulder strap down the shoulder or lift the cup up over the breast.

Because the shoulder strap is connected to the inner cup of the brassiere, pulling down the outer cup of the brassiere will not cause the shoulder strap to slip over the shoulder and disappear, the brassiere will not feel loose and the supporting effect of the brassiere on the other breast will not disappear.

The woman can now place the child at the exposed breast and perform the nursing, after which she can support the child with one hand/arm while she pulls the outer cup of the brassiere back up with the other hand and fastens the cup to the shoulder strap and, possibly, unfastens the other outer cup of the brassiere from the other shoulder strap, pulls down the second outer cup of the brassiere and places the child at the other breast.

To manufacture the brassiere, two layers are formed from a circularly knitted fabric blank which are folded and assembled substantially without seams. In order to achieve the desired shape of a brassiere, material is removed from one of the two layers, typically material from the inner layer.

By producing the brassiere in a circularly knitted fabric it is, furthermore, possible to manufacture a seamless brassiere from one piece of fabric, where it has been taken into account in the production of the circularly knitted fabric blank that the different parts of the brassiere must perform different functions.

The cups are knitted as pouches on the circularly knitted blank with a knitted structure looser than that of the surrounding fabric areas. This makes the cups comfortably elastic and able to surround and maintain the breasts in the desired position.

The center portion between the two cups must be manufactured from a piece of fabric which is shorter and/or has less elasticity than the cups per se. This means that the center portion pulls in on the material which forms the cups and joins the material in front on the front portion and, thus, assists in forming two cups and maintaining the shape of the cups. If the center portion is not made from a shorter and/or lesser elastic material, the effect of two cups will not be achieved, but only one cup is manufactured which supports both breasts at the same time.

The back portion of the brassiere can be manufactured in various designs by changing the knitting structure and/or using different yarns in the knitting to make a certain design or logo.

Furthermore, a brassiere with an extra back supporting effect can be made. In order to achieve an increased supporting effect from special areas of the back portion, the knitting structure is changed during the production of the part of the circularly knitted blank which makes out the back portion.

The same applies for the side portions which connect the front portion and back portion. Here it is also possible to have areas with a different knitting structure for the purpose of a desired design or a supporting effect.

The edge of the brassiere is made from an elastic material which can be either ribbed, plain or differently manufactured, depending on the design and use of the brassiere. The most important thing is, however, that the brassiere fits snugly around the chest in the area just below the breasts keeping the brassiere close to the body and helping to support the breasts. Since the brassiere is made from a circularly knitted fabric blank this also means that the edge portion is manufactured as a band which means that the brassiere goes over the head and down around the chest.

In another embodiment the brassiere can be provided with a vertical closing device so that the brassiere, like ordinary known brassieres, can be closed in the back or in front between the cups. This requires the back portion or the front portion to have a different design or the use of a closing device, which comprises several clasp devices or a very wide clasp device or a hook/loop device.

A brassiere according to the invention is, typically, knitted from yam made from one or more of the following fiber types; elastane/Spandex, polyamide, polyester, cotton, wool and/or silk. The elastane/Spandex provides the knitted fabric with an elastic effect.

The mentioned yarns can be of micro fiber quality or of regular fiber thickness. If the brassiere has been provided in a fabric knitted from micro fibers it will have a natural softness which increases the comfort of the woman wearing the brassiere.

The clasp elements are, typically, made from plastic material or metal alloys, which can be colored and/or varnished to match the brassiere or colored to be accentuated decoratively to match the color of the brassiere. The clasp elements can, however, also be manufactured from polyamide, polyester or the like so that they can be colored with the fabric of a brassiere.

In order to pull down a cup when a woman is to nurse a child, the brassiere is provided with a clasp device, which comprises a first and second clasp, where the first clasp is an eye element and the second clasp a hook element. Alternatively, the first clasp is a hook element and the second clasp is an eye element. For both embodiments apply that the two clasps have been made in such a way that they correspond to each other and can be closed in engagement. These clasps ensure that the brassiere is kept together and in place, while at the same time making it possible for the woman to loosen and fasten a cup with only one hand, which is a great advantage when she is supporting a child with the other hand at the same time.

In the first embodiment the eye element can, alternatively, be provided by an opening in the upper edge of the fabric of the outer cup of the brassiere. This requires that the shoulder strap is provided with a hook element. The reverse applies for the alternative embodiment where the eye element is provided by an opening in the shoulder strap. This requires that a hook element is provided on the upper edge of the outer cup of the brassiere.

Alternatively, a clasp device with hook and loop can be used when the hook part or loop part is placed between the inner cup and the strap, while the corresponding part is fastened at the edge of the outer cup.

Because women's breasts are not the same shape and size it is expedient to manufacture different types and sizes of brassieres, which is why a number of different brassieres have been provided according to the invention, in which:

- in a first embodiment the inner cup layer is provided as a part of a complete cup which supports the outer side and under a breast;
- in a second embodiment the inner cup layer is provided as a part of a complete cup which support the inner side and under the breast;
- in a third embodiment the inner cup layer is provided as a part of a complete cup and in two parts, where one part supports the outer side and under the breast and where the other part support the inner side and under a breast;
- in a fourth embodiment the inner cup layer is provided as a complete cup in which a hole has been provided centrally for circling a nipple.

In the first three embodiments the inner cup layer can, alternatively, be provided as a part of a complete cup, which only supports on the outer side and/or inner side of a breast.

These different types of brassieres with different embodiments of the inner cup of the brassiere allows women to find the type best suited for them. Furthermore, it is possible to use different types of brassieres in the nursing period.

In an alternative embodiment where a brassiere allows an easy exposure of a breast and is comfortable to wear, the brassiere is formed such that the brassiere, preferably for use when nursing, comprises a front portion with two cups, wherein a center portion is arranged between the two cups, a back portion, two side portions connecting the front and back portion, a band which fits snugly around the chest under the breasts and a pair of shoulder straps extending from the back portion and connected to each of the cups of the front portion, wherein the brassiere is manufactured without seams from a single piece of circularly knitted fabric, where, in a position immediately above or at the upper edge of each cup, is provided a first clasp, which co-operates in a easily releasable manner with a corresponding second clasp on a shoulder strap and that a center strap, which co-operates in a easily releasable manner with one of the mentioned other clasps on the two shoulder straps.

In this embodiment of the brassiere there are no inner cups and when one of the cups is pulled down, the entire breast will be exposed and the breast will be supported on the inner side by the cup/center portion, which has been pulled down, and by the edge of the brassiere, which provides support under the breast.

In order to keep the brassiere together during nursing, a center strap is attached to the center portion, which, when a cup is pulled down, is fastened to the belonging shoulder strap. This means that the brassiere is kept together and that the breast not nursing is supported and covered.

In order to connect the center strap with the shoulder strap, the connection has been provided in such a manner that said first clasp is an eye element, that said second clasp is a hook element and that said center strap is provided with an eye element, which in one embodiment can be provided by fastening an eye element, made of e.g. plastic or metal to the loose end of the center strap.

In another embodiment the center strap can be made from two layers of fabric which are joined in one or more places across the center strap, so that a number of eye elements are formed. Furthermore, this embodiment of the center strap allows the center strap to be used for adjusting the length of the shoulder strap during nursing, achieving the best possible support of the brassiere and a comfortable placing of the shoulder strap/center strap above the exposed breast.

The cup is connected to the shoulder strap with a clasp placed in a position immediately above or at the upper edge of each cup. This clasp can be an eye element, which either is a plastic/metal part or is made from the fabric of the upper edge of the cup. This embodiment of the brassiere requires two hands for pulling down a cup and for changing cups.

In a further embodiment of this brassiere, the hook element of the shoulder strap can be doubled, making it possible to first fasten the center strap to the first hook element with one hand and, subsequently, loosen the cup from the other hook element.

In order to expose both breasts at once the center strap, which is fastened in the upper edge of the center portion, can be provided with two ends in which there is an eye element or hook element. This eliminates the need for the center strap to be moved from side to side when changing breasts during nursing.

In an alternative embodiment the brassiere is manufactured substantially without seams and with sewn-in inner cups and the brassiere is formed such that the brassiere, preferably for use when nursing, comprises a front portion with two cups, wherein a center portion is arranged between the two cups, a back portion, two side portions connecting the front and back portion, a band which fits snugly around the chest under the breasts and a pair of shoulder straps extending from the back portion and connected to each of the cups of the front portion and where the cups are formed completely or partly from a double layered fabric, wherein the brassiere, without the inner layers, is manufactured without seams from a piece of fabric and the inner layers of the cups are formed from one or more pieces of fabric and wherein, at a position immediately above or at the upper edge of each cup, a first clasp is provided, which cooperates in a easily releasable manner with a corresponding second clasp on a shoulder strap and that said second clasp connects the shoulder strap to an inner cup layer.

In this embodiment the inner cups and the brassiere are manufactured separately, whereby the brassiere with outer cups is manufactured without seams from one piece of fabric and the inner cups are manufactured in one or more parts, which are cut out or shaped in another manner.

The shape of the inner cups of the brassiere can, like the brassiere manufactured without seams from a piece of circularly knitted fabric, be either a part of a complete cup, which supports the outer side and under a breast, or can be a part of a complete cup, which supports the inner side and under a breast or as a part of a complete cup and in two parts, where one part supports the outer side and under the breast and where the other part support the inner side and under a breast or as a complete cup, in which a hole is provided centrally for circling a nipple.

When producing the inner cups of the brassiere in one or more portions it is, furthermore, possible to manufacture inner cups for certain specific purposes, such as e.g. nursing pads, breast prosthesis or bandages. Production wise it may be easier to form such inner cups from one or more separate pieces of fabric.

In order to achieve that the outer cups can be pulled down and expose the woman's breast while allowing the inner cups of the brassiere to support the exposed breast at the same time, the inner layers of the cups are completely or partly fastened to the edge of the brassiere and/or side portions.

The fastening of the separate inner cups to the brassiere can be placed either with a seam along the entire lower edge of the inner cups or at the upper edge of the brassiere edge, or with a partial seam along the lower edge of the inner cups and the upper edge of the brassiere edge, or with a seam at the middle of the lower edge of the inner cups and/or with seams to the side portions of the brassiere.

These seams between the brassiere and inner cups are, typically, made by sewing, but other joining methods such as welding or gluing can be used.

When producing a brassiere with sewn-in inner cups there are several parameters which are important in order to manufacture a brassiere which is equally comfortable for the user and performs the same functions as a brassiere made without seams from a single piece of circularly knitted fabric.

The inner cups must be formed from a fabric which is elastic and has a natural softness since the inner cup will be in contact with the woman's breast at all times. As described earlier the fabric may be one or more of the following fiber types; elastane/ Spandex, polyamide, polyester, cotton, wool and/or silk, and it may be knitted from micro fibers, which gives the fabric a natural softness.

The manufacturing of separate inner cups provides the opportunity of choosing other materials or other fabric constructions/structures for the inner cups as opposed to the outer cups and thereby achieve other support effects and/or stretch relations.

The shape of the inner cups must ensure that no visible and irritating seams are created when several pieces of fabric are joined together, as the seams could apply pressure on the breast tissue, thus causing discomfort for the woman wearing a brassiere with sewn-in inner cups.

The fastening method of the inner cups to the brassiere must ensure that no irritating seams are created. The cup will, typically, be fastened where there already is a shift in the structure, so that the fastening is as least visible and irritating as possible.

A brassiere with sewn-in inner cups will, therefore, in comparison with a brassiere made substantially without seams from a single piece of circularly knitted fabric, also achieve the object of the invention by providing a brassiere which is comfortable to wear and which allows a nursing woman easy access to exposing one breast at a time.

BRIEF DESCRIPTION OF THE ATTACHED DRAWINGS

Figure 2:
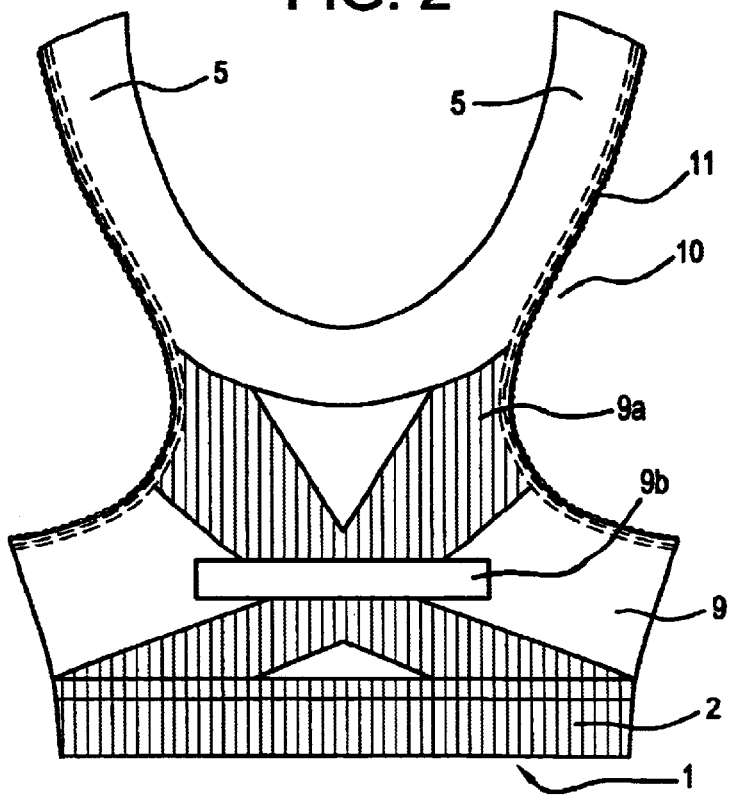
Figure 3:
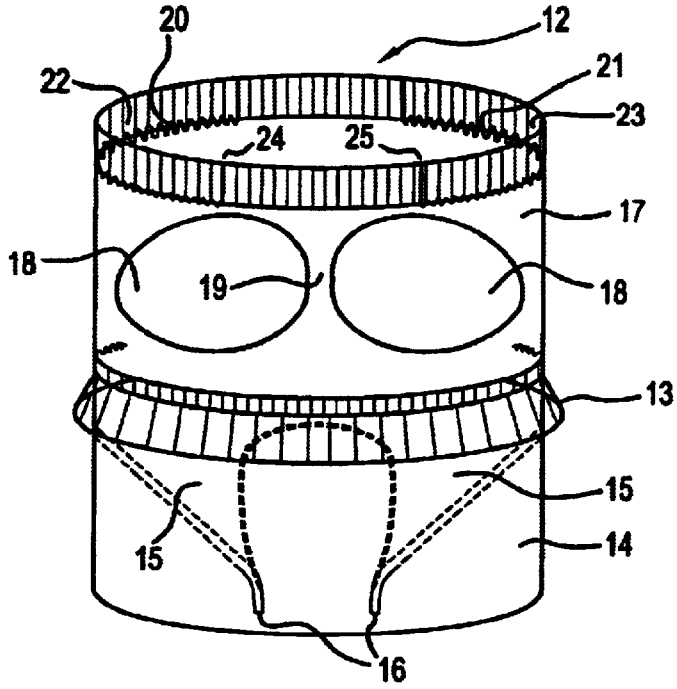
Figure 4:
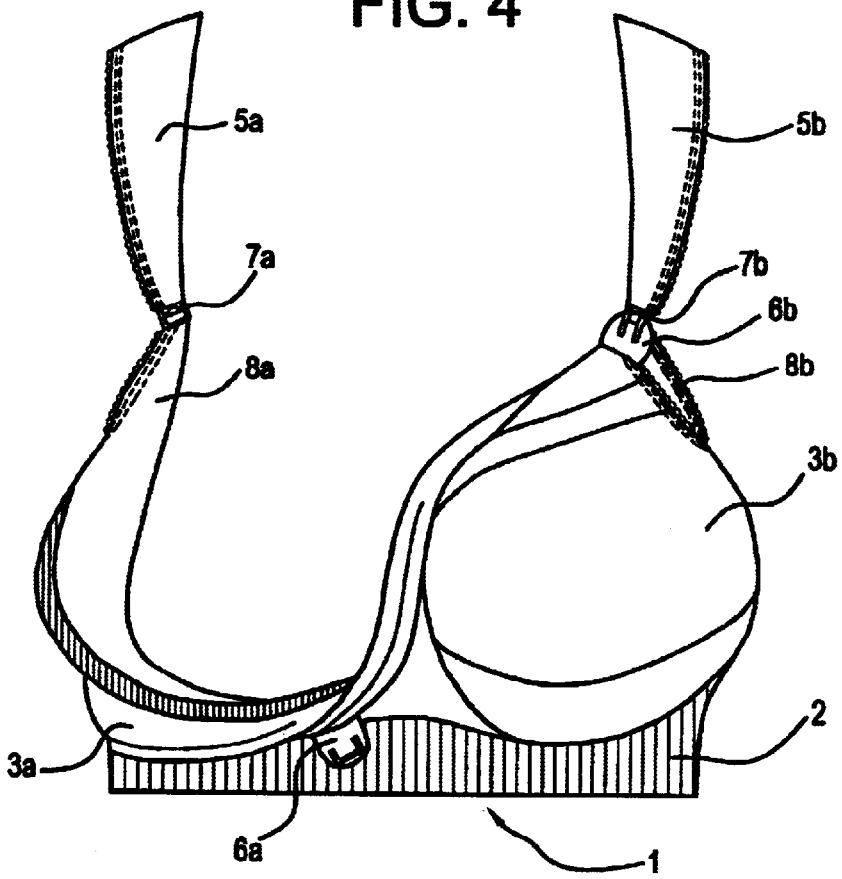
Figure 5:
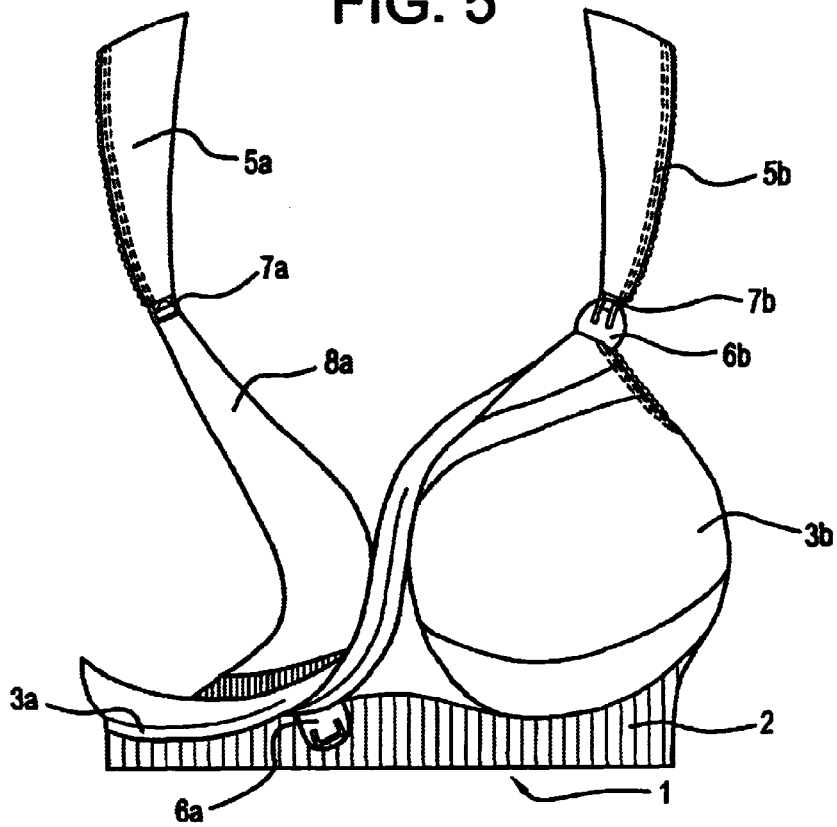
Figure 6:
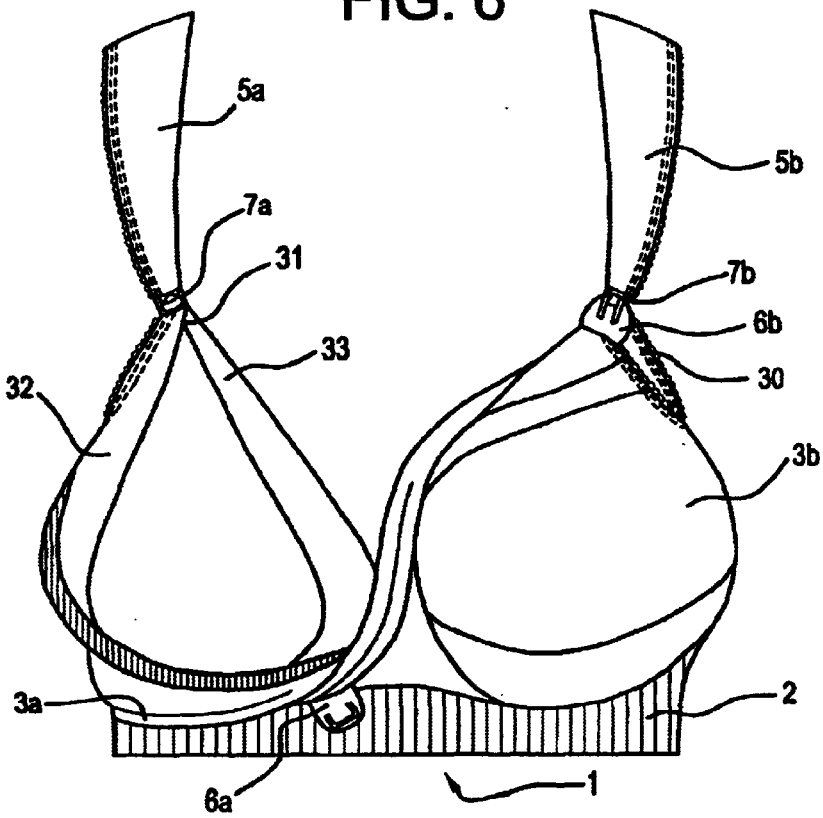
Figure 7:
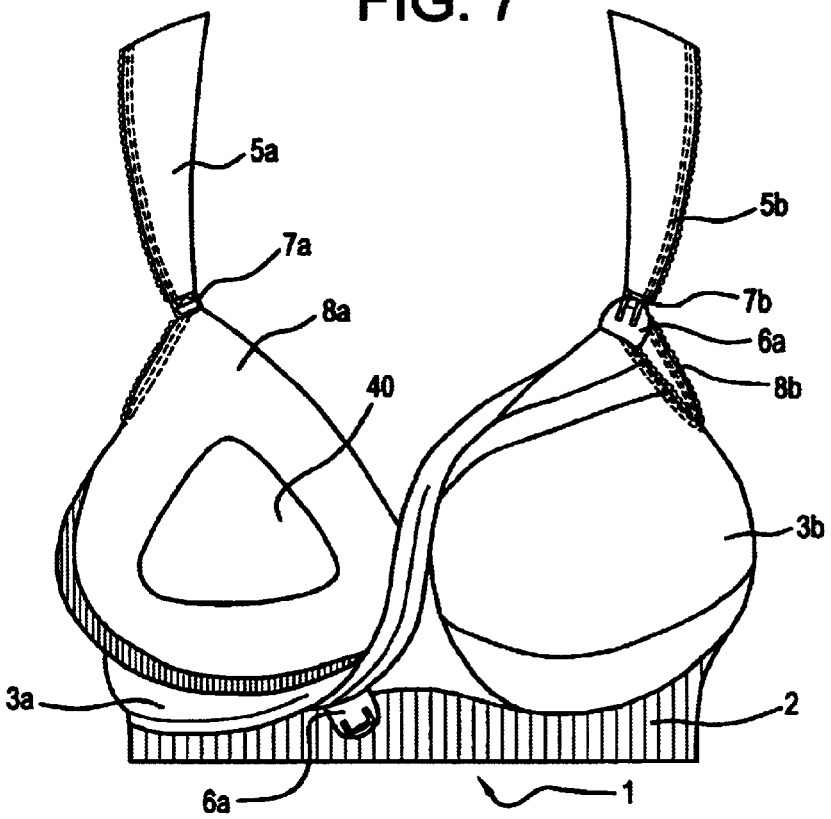
Figure 8:
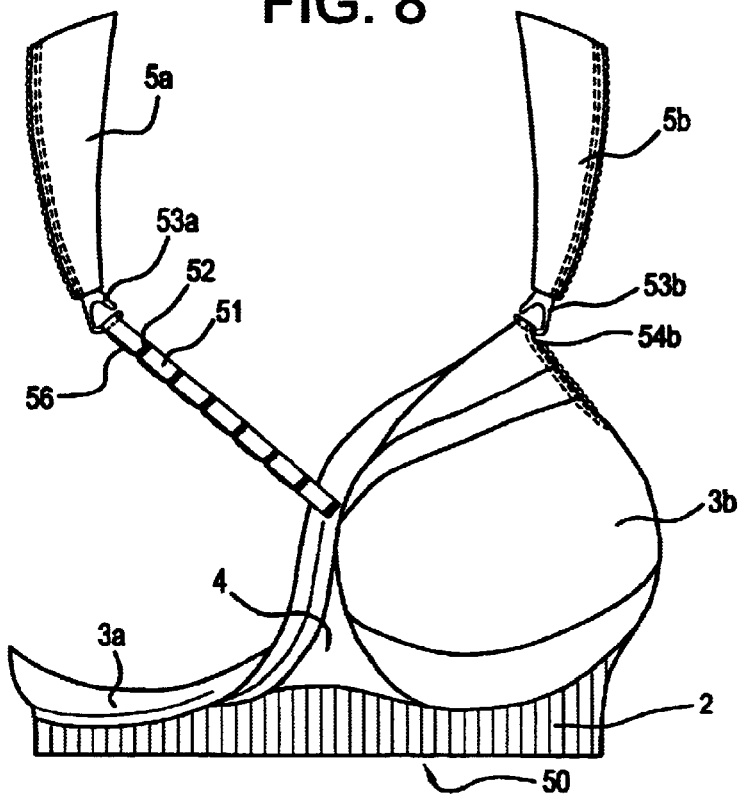
Figure 9:
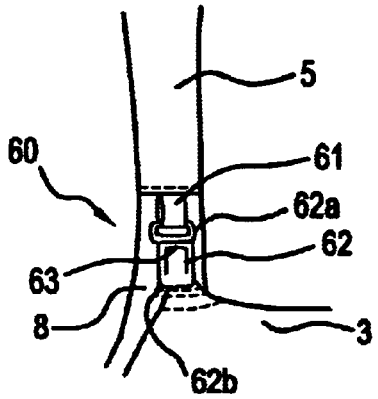
Figure 10:
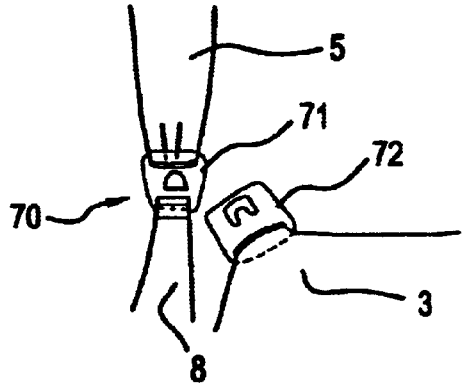
Figure 11:
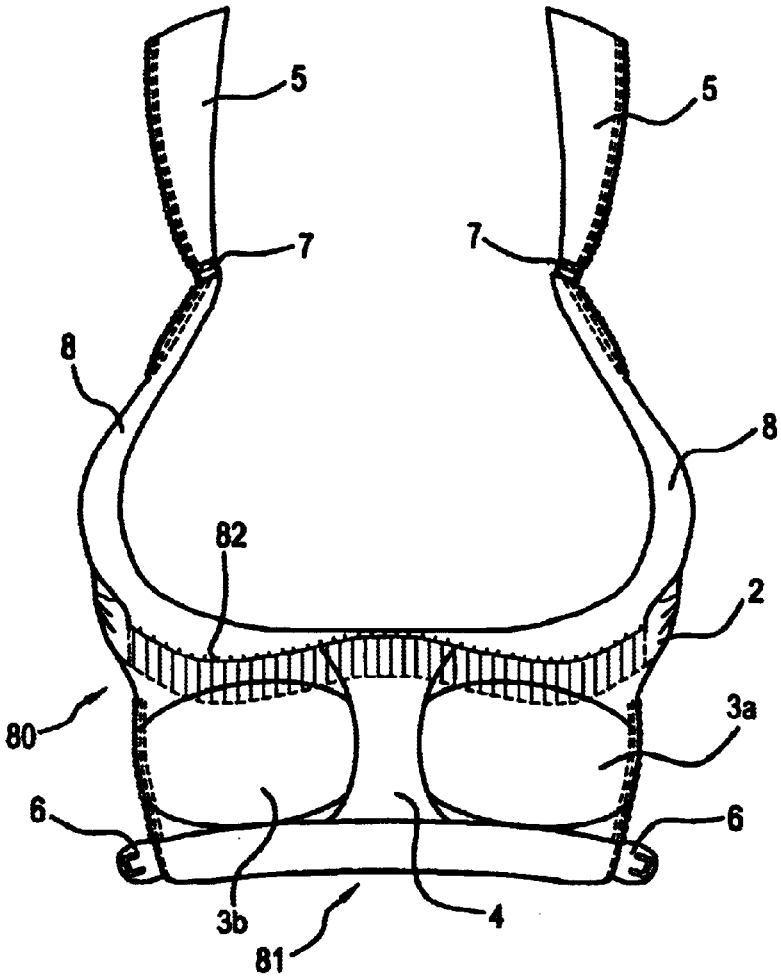
Figure 12:
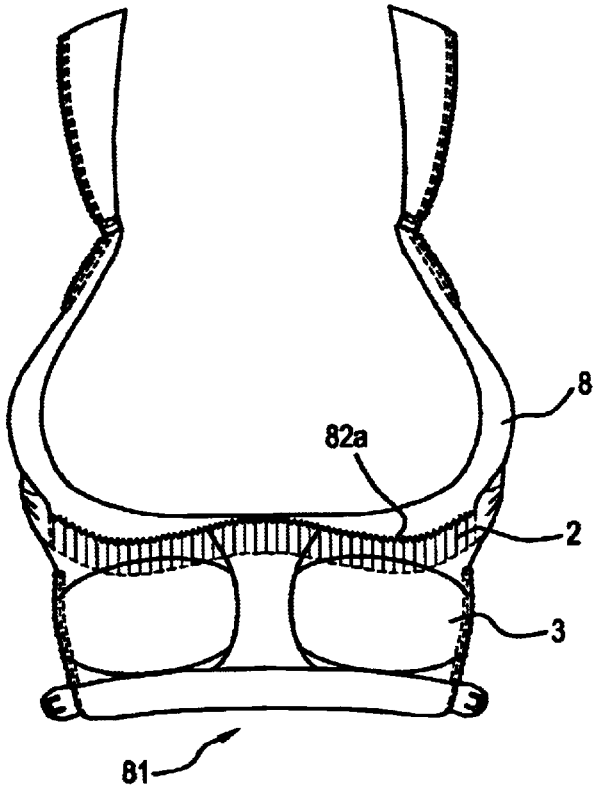
Figure 13:
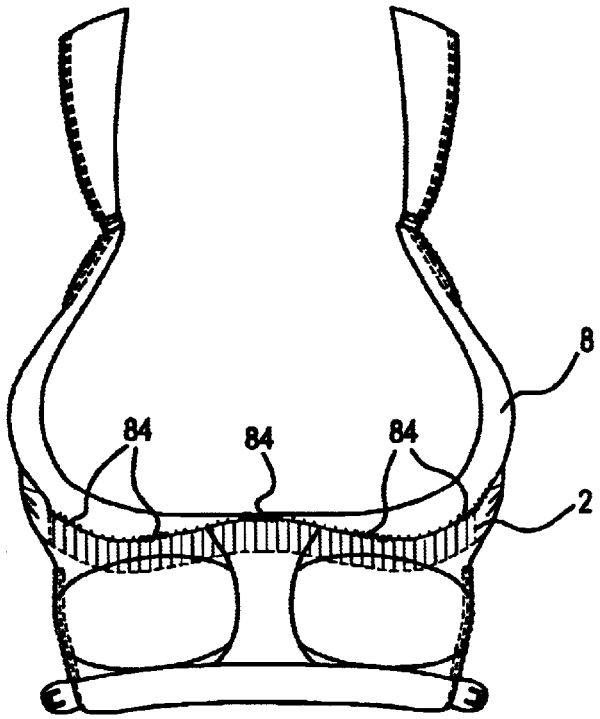
Figure 14:
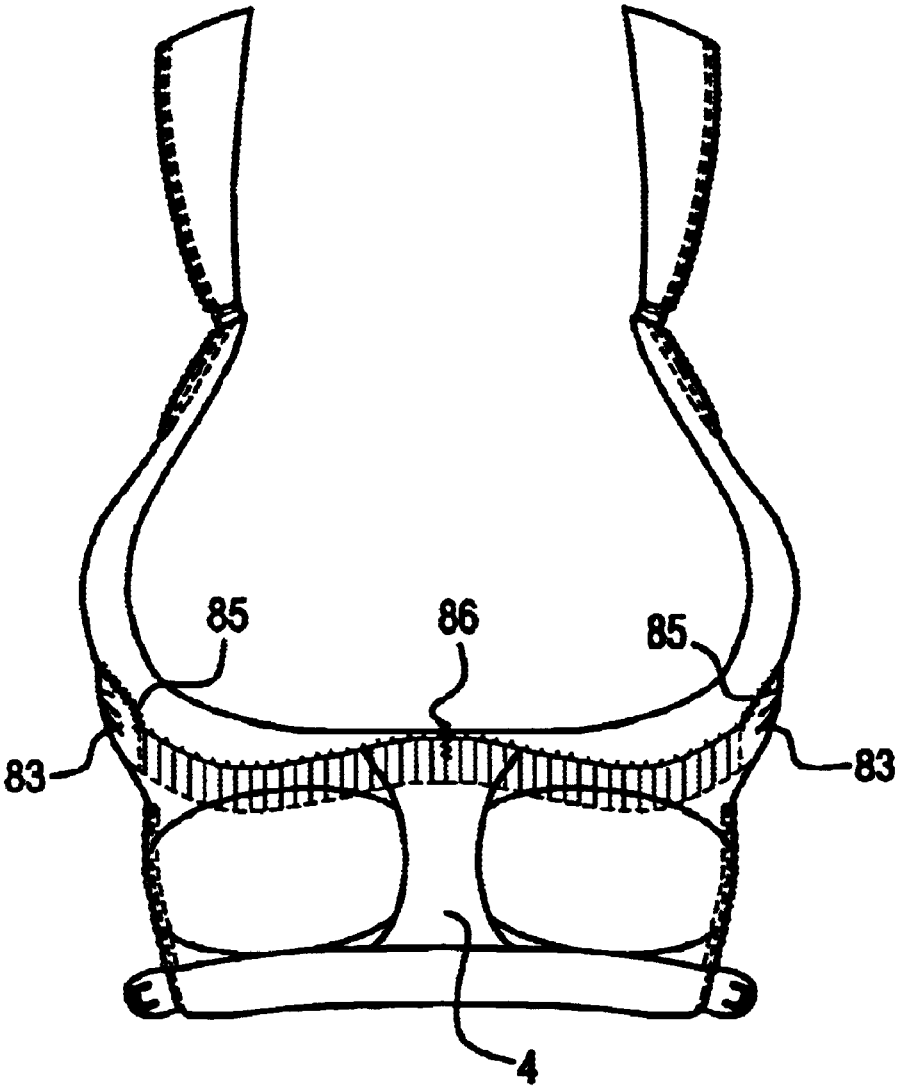

In the following there is a detailed explanation of the invention with reference to the drawings, in which FIG. 1 shows a front view of a brassiere according to the invention, FIG. 2 shows a back view of the brassiere in FIG. 1, FIG. 3 shows a view of a seamless circularly knitted blank, FIG. 4 shows a front view of a first embodiment of the brassiere according to the invention, FIG. 5 shows a front view of a second embodiment of the brassiere according to the invention, FIG. 6 shows a front view of a third embodiment of the brassiere according to the invention, FIG. 7 shows a front view of a fourth embodiment of the brassiere according to the invention, FIG. 8 shows a front view of a fifth embodiment of the brassiere according to the invention, FIG. 9 shows a detailed view of an alternative clasp according to the invention, FIG. 10 shows a detailed view of a second alternative clasp according to the invention, FIG. 11 shows a front view of a sixth embodiment of the brassiere according to the invention, FIG. 12 shows a front view of a brassiere with a seam according to the invention, FIG. 13 shows a front view of a brassiere with an alternative seam according to the invention and FIG. 14 shows a front view of a brassiere with another alternative seam according to the invention.

DETAILED DESCRIPTION OF THE PREFERRED EMBODIMENT(S)

The front view shown in FIG. 1 indicates a brassiere 1 comprising a band part 2 and two cups 3, a center portion 4 and two shoulder parts 5. At the upper edge of each cup 3 a clasp 6 is provided, which is connected with a clasp 7, which in turn is connected with a shoulder strap 5. In this embodiment the clasp 6 is an eye element and the clasp 7 is a hook element in the sides and behind the cup 3 is seen a part of an inner cup 8, which is connected with a hook element 7. The band part 2 of the brassiere is here shown in a plain embodiment.

In FIG. 2 is indicated the back portion of a brassiere 1 comprising a band part 2, which in this embodiment is ribbed, a back portion 9 divided into several areas, where the fabric is knitted with different knitting structures and/or different yarns. Area 9*a* is knitted with a knitting structure which provides the fabric with a supporting effect in the back portion. In area 9*b* the knitting structure is changed so that a text or logo is formed. The back portion 9 is, subsequently, distributed upwards and out into two shoulder straps 5. In the arm opening 10 a band 11 is sewn on. Alternatively, the arm opening 10 can be folded and fastened by stitching, such as a lock stitching.

In FIG. 3 is shown how a brassiere 1 is made from a circularly knitted blank 12. Approximately at the middle of the circularly knitted blank 12 a knitted loop 13 is created, which later forms the band part 2 of the brassiere.

From the lower part 14 of the circularly knitted blank 12 the inner cups 15 are formed, which are folded to a position behind the cups 18. The part of the lower part 14 which is not used for the inner cups 15 is cut off. On the inner cups 15 two end portions 16 are seen, which are to be connected with a clasp (not shown) and the shoulder straps 22, 23. This ensures that the brassiere 1 always is kept together even if one or both cups 18 are pulled down.

From the middle portion of the circularly knitted blank 12 the back portion (not shown), the front portion and cups 18 and side portions (not shown) are formed. Between the two cups there is a center portion 19.

The zigzag line 20 and 21 indicates the areas opened for arm openings. The parts 23 and 22 are, subsequently, used as shoulder straps 5 after these have been cut in the cutting lines 24 and 25.

The part of the shoulder straps 22 and 23 closest to the cutting lines 24 and 25 is the part that is provided with a clasp (not shown), which later is connected with the end portions 16 of the inner cups 15.

In an alternative embodiment the shoulder straps can be provided by knitting a top part at the upper edge of the middle portion 17, which largely corresponds to the shape of the piece of fabric from which the inner cups 15 are formed. The surplus fabric is removed and the shoulder straps are fastened to the back portion. In this embodiment the arm openings and shoulder straps must, however, be either folded and stitched or have a band sewn on.

FIG. 4 shows a front view of a first embodiment of a brassiere 1 comprising a band portion 2, a left cup 3*a*, which has been pulled down, and a right cup 3*b* which still is in place and fastened to a shoulder strap 5*b*. On the cup 3*a*, which has been pulled down, the clasp 6*a*, which is an eye element, is seen. At the top of the cup 3*b* is seen the clasp element 6*b*, which is fastened to the clasp element 7*b*.

As can be seen on the left side of the brassiere, a shoulder strap 5*a* is connected with a clasp element 7*a*, which in turn is connected with an inner cup 8*a*, where the inner cup 8*a* is a partial cup, which supports the breast (not shown) on the outside and under the breast (not shown). As indicated the woman nursing will easily be able to unfasten the clasp 6*a* or 6*b* and pull down the cups 3*a* and/or 3*b*. Furthermore, it is here possible to loosen both cups at the same time without loosing the grip on the brassiere, which is kept together by the shoulder straps 5*a* and 5*b* that are connected through the clasps 7*a* and 7*b* to the inner cups 8*a* and 8*b*.

In FIG. 5 another embodiment of the brassiere 1 can be seen, which comprises a ribbed band portion 2, a left cup 3*a*, which has been pulled down, and a right cup 3*b*, which is in place and fastened to the shoulder strap 5*b*. At the upper edge of the right cup 3*b* a clasp 6*b* is provided, which is an eye element fastened to a hook element 7*b* , which connects the shoulder strap 5*b* with an inner cup 8*b* (not shown).

As can be seen at the left side of the brassiere 1 a shoulder strap 5*a* is connected to a clasp 7*a*, which in turn is connected with the upper edge of the inner cup 8*a*, where the inner cup 8*a* is a part of a cup, which here supports the breast (not shown) on the inner side and down between the breasts (not shown) and under the breast (not shown). At the cup 3*a*, which has been pulled down, a clasp element 6*a* is provided, which in this case is an eye element.

In FIG. 6 is seen a third embodiment of a brassiere 1, which comprises a ribbed band 2, a cup 3*a*, which has been pulled down, and a right cup 3*b*, which is in place and fastened to the shoulder strap 5*b*. At the upper edge of the cup 3*b* an eye element 6*b* is provided, which is fastened to another clasp element 7*b*, which connects the shoulder strap 5*b* with the inner cup 30.

As can be seen on the left side of the brassiere 1 the shoulder strap 5*a* is connected to a clasp element 7*a*, which in turn is connected to an inner cup 31, where the inner cup 31, which corresponds to the inner cup 30, is provided in two parts - a part 32, which supports the breast on the outside and under the breasts and a part 33, which supports on the inner side of the breast, down between the breasts and under the breast. On the cup 3*a*, which has been pulled down, a clasp element 6*a* is provided, which in this case is an eye element.

In FIG. 7 is seen a fourth embodiment of the brassiere 1 comprising a ribbed band 2, a left cup 3*a*, which has been pulled down, and a right cup 3*b*, which is in place and fastened to the shoulder strap 5*b*. At the upper edge of the right cup 3*b* a clasp 6*b* is provided, which is in an eye element that is fastened to a hook element 7*b*, which connects the shoulder strap 5*b* with the inner cup 8*b*.

As can be seen on the left side of the brassiere 1 the shoulder strap 5*a* is connected to a clasp element 7*a*, which in turn is connected to an inner cup 8*a*, where the inner cup 8*a* is a complete cup, which has a centrally placed hole 40 surrounding the nipple (not shown). This hole for the nipple must be dimensioned such that the brassiere 1 can be used by women with widely different breast sizes and different nipple placements. On the cup 3*a*, which has been pulled down, a clasp element 6*a* has been provided, which in this case is an eye element.

In FIG. 8 is seen a brassiere 50 with a ribbed band 2, a right cup 3*b* and a left cup 3*a*, which has been pulled down. At the central center portion 4 a center strap 51 has been provided on the inner side, which is sewn together in several places across the center strap 51 so that the seams 52 form a number of eye elements 56, which can be fastened to the hook element 53.

The seams 52 on the center strap 51 mean that the shoulder strap 5*a* and strap 51 can be displaced in the longitudinal direction, so that the brassiere 50 can be tightened during use.

The shoulder strap 5*a* is connected to the hook element 53*a*, which in turn is connected to the outer eye element 56 of the center strap 51. This means the shoulder strap 5*a* is controlled and the brassiere 50 will still have a supporting effect on the breast not used, even if the cup 3*a* is pulled down.

In order to pull a cup down the cup 3*a* must be unfastened from the hook element 53*a* and the center strop 51 fastened to the hook element 53*a*. In order to change breasts the center strap 51 must be loosened from the hook element 53 and the eye element 54*a* (not shown) of cup 3*a* must be fastened to the hook element 53*a*, the eye element 54*b* of cup 3*b* loosened from the hook element 53*b* and the center strap 51 fastened to the hook element 53*b*.

When the brassiere 50 is not used as a nursing brassiere the center strap 51 hangs from the back side of the central portion 4. The center strap 51 can be fastened to the central portion 4 with either a seam or a decorative element, such as a button, an embroidery or a broche like element.

In FIG. 9 is shown another clasp element 60 with another type of clasp 62, which comprises a two-portion buckle provided such that the clasp 62*a* and clasp 62*b* engage slidingly with each other when pressed together. On the top side of the clasp 62*b* a releaser 63 is placed, which when pressed releases the engagement so that the two clasps can be separated. The clasp 62*a* is connected either by an eye element 61 or directly connected to a shoulder strap 5 and inner cup 8, while the clasp 62*b* is connected with an upper edge of the cup 3.

In FIG. 10 is shown a third clasp arrangement 70 with a first clasp 71 and a second clasp 72. The clasp 71 is a hook element comprising a back plate, a hook and two holes, in which the clasp 71 is connected to the inner cup 8 and shoulder strap 5. The clasp 72 is an eye element, which fits into engagement with the hook of clasp 71. The clasp 72 is connected to the upper edge of cup 3.

The clasp devices shown in the drawings are ordinary known clasp devices generally used in the business for nursing brassieres. There are other corresponding clasp devices which are equally useable.

In FIG. 11 is shown a brassiere 80 with a ribbed band 2, a front portion 81, which has been pulled down, with a right cup 3*b*, a left cup 3*a* and a center portion 4. Between the cups 3*a* and 3*b* of the front portion 81 and the band 2 is an edge 82, onto which the lower edge of the inner cups 8 can be fastened. The inner cups 8 are connected to the shoulder straps 5 with the clasps 7. At the top of the cups 3*a* and 3*b* is provided clasps 6, which by engagement with the clasps 7 makes it possible to lift the front portion 81 up in front of the inner cups 8 and thus cover the breasts.

FIG. 12, 13 and 14 show various ways of joining the inner cups 8 with the band 2 and/or side portions 83 of the brassiere.

In FIG. 12 the lower edge of the inner cups 8 is fastened between the front portion 81 and the band 2 by a seam 82*a*.

In FIG. 13 the lower edge of the inner cups 8 is partly fastened between the front portion 81 and the band 2 by a number of seams 84.

In FIG. 14 the lower edge of the inner cups 8 is fastened at the lower end of portion 4 in the middle between the front portion 81 and band 2 with seams 86 and to the side portions 83 of the brassiere with seams 85.

The invention is not limited to the applications shown in the drawings and the embodiments described above. Other embodiments comprise other forms of the brassiere, the inner layers of the brassiere and the clasp devices, which are possible within the scope of the present invention and as described in the claims.

What is claimed is:

1. Brassiere, preferably for use when nursing, comprising a front portion with two cups, wherein a center portion is arranged between the two cups, a back portion, two side portions connecting the front and back portion, a band which fits snugly around the chest under the breasts and a pair of shoulder straps extending from the back portion and connected to each of the cups of the front portion and where the cups are completely or partly formed from a double layered fabric, wherein the brassiere is manufactured without seams from a single piece of circularly knitted fabric, wherein at a position immediately above or at the upper edge of each cup, a first clasp is provided, which co-operates in a easily releasable manner with a corresponding second clasp on a shoulder strap and wherein said second clasp connects the shoulder strap with an inner cup layer.

2. Brassiere according to claim 1, wherein the first clasp is an eye element and the second clasp a hook element.

3. Brassiere according to claim 1, wherein the first clasp is a hook element and the second clasp an eye element.

4. Brassiere according to claim 1, wherein the inner cup layer is formed as a part of a complete cup which supports the outer side and under a breast.

5. Brassiere according to claim 1, wherein the inner cup layer is formed as a part of a complete cup, which supports the inner side and under a breast.

6. Brassiere according to claim 1, wherein the inner cup layer is formed as a part of a complete cup and in two parts, where one part supports the outer side and under a breast and where the other part supports the inner side and under a breast.

7. Brassiere according to claim 1, wherein the inner cup layer is formed as a complete cup, in which a hole has been provided centrally for circling a nipple.

8. Brassiere, preferably for use when nursing, comprises a front portion with two cups, wherein a center portion is arranged between the two cups, a back portion, two side portions connecting the front and back portion, a band which fits snugly around the chest under the breasts and a pair of shoulder straps extending from the back portion and connected to each of the cups of the front portion, wherein the brassiere is manufactured without seams from a single piece of circularly knitted fabric, where, in a position immediately above or at the upper edge of each cup, is provided a first clasp, which cooperates in a easily releasable manner with a corresponding second clasp on a shoulder strap and that a center strap, which co-operates in a easily releasable manner with one of the mentioned other clasps on the two shoulder straps.

9. Brassiere according to claim 8, wherein said first clasp is an eye element and that said second clasp is a hook element and that said center strap is provided with an eye element.

10. Brassiere, preferable for use when nursing, comprising a front portion with two cups, wherein a center portion is provided between the two cups, a back portion, two side portions connecting the front and back portion, a band fitting snugly around the chest under the breasts and a pair of shoulder straps extending from the back portion and connected to each of the cups of the front portion and where the cups are partly or completely formed from a double layered fabric, wherein the brassiere without the inner cup layers is manufactured without seams from one piece of fabric and the inner layers of the brassiere are manufactured from one or more pieces of fabric, and wherein, at a position immediately above or at the upper edge of each cup, a first clasp is provided, which co-operates in a easily releasable manner with a corresponding second clasp on a shoulder strap and that said second clasp connects the shoulder strap to an inner cup layer.

11. Brassiere according to claim 10, wherein the inner cup layers is completely or partly fastened to the edge of the brassiere and/or side portions.

* * * * *